US007810432B2

(12) United States Patent
Stevens et al.

(10) Patent No.: US 7,810,432 B2
(45) Date of Patent: Oct. 12, 2010

(54) PROJECTILE CARTRIDGE WAD

(75) Inventors: Henry Stevens, Barnsley (GB); Peter Morris, Barnsley (GB)

(73) Assignee: Pvaxx Research and Development Limited, Barnsley, Cirencester (GB)

( * ) Notice: Subject to any disclaimer, the term of this patent is extended or adjusted under 35 U.S.C. 154(b) by 0 days.

(21) Appl. No.: 11/813,953

(22) PCT Filed: Jan. 13, 2006

(86) PCT No.: PCT/GB2006/000117

§ 371 (c)(1),
(2), (4) Date: Mar. 26, 2008

(87) PCT Pub. No.: WO2006/075168

PCT Pub. Date: Jul. 20, 2006

(65) Prior Publication Data

US 2008/0223245 A1 Sep. 18, 2008

(30) Foreign Application Priority Data

Jan. 13, 2005 (GB) ..... 0500663.0

(51) Int. Cl.
*F42B 7/08* (2006.01)

(52) U.S. Cl. ..... 102/453

(58) Field of Classification Search ..... 102/450, 102/451, 453
See application file for complete search history.

(56) References Cited

U.S. PATENT DOCUMENTS 3,180,265 A * 4/1965 Rybak ..... 102/451
3,266,421 A * 8/1966 Comerford ..... 102/451
3,368,489 A * 2/1968 Herter ..... 102/451
3,804,019 A 4/1974 Hurley
3,810,468 A 5/1974 Harper et al.
3,812,784 A * 5/1974 Herter ..... 102/451
3,827,363 A * 8/1974 Curran ..... 102/532

(Continued)

FOREIGN PATENT DOCUMENTS

EP 0 181 473 5/1986

(Continued)

OTHER PUBLICATIONS

International Hunter Education Association, Inc., http://homestudy.ihea.com/ammo/12shell.htm (Dec. 16, 2004).

*Primary Examiner*—Bret Hayes
(74) *Attorney, Agent, or Firm*—Stites & Harbison PLLC; Stephen J. Weyer

(57) ABSTRACT

A wad for a projectile cartridge comprises a holder for holding a projectile, such as a plurality of shot, a charge barrier, and a support for mounting the holder to the barrier. The wad is unitary and is formed from a biodegradable plastic material. The barrier is preferably compressible, and more preferably substantially more compressible than the support. The wad has a first moisture content and is adapted to be conditioned, prior to employment in a projectile cartridge, to have a second moisture content. After conditioning, the weight of the wad may be increased by up to 19%, or the size of the wad maybe increased in at least one dimension by up to 6%. A projectile cartridge employing the wad, and a method of making the wad and the projectile cartridge are also disclosed, together with tools for making the wad and sleeve.

28 Claims, 4 Drawing Sheets

U.S. PATENT DOCUMENTS

| | | | | |
|---|---|---|---|---|
| 3,954,721 | A | 5/1976 | Gross | |
| 3,980,663 | A | 9/1976 | Gross | |
| 3,983,095 | A | 9/1976 | Bashaw et al. | |
| 4,151,799 | A * | 5/1979 | Jackson | 102/451 |
| 5,263,417 | A * | 11/1993 | Godfrey-Phillips | 102/453 |
| 5,795,923 | A | 8/1998 | Shahid | |
| 6,544,452 | B1 | 4/2003 | Stevens | |
| 7,026,375 | B1 | 4/2006 | Stevens | |
| 2004/0099172 | A1 | 5/2004 | Schikora et al. | |

FOREIGN PATENT DOCUMENTS

| | | |
|---|---|---|
| FR | 2 370 258 | 6/1978 |
| GB | 2 253 267 | 9/1992 |
| GB | 2 367 606 | 4/2002 |
| JP | 2000 266500 | 1/2001 |
| WO | WO-2006/075174 | 7/2006 |

* cited by examiner

PROJECTILE CARTRIDGE WAD

TECHNICAL FIELD

The present invention relates to projectile cartridges and their components. In particular, the invention relates to shotgun wads. Methods of making such cartridges and their components are also disclosed.

BACKGROUND ART

Breech loadable shotgun cartridges are well known, typically comprising either a fibre or plastic wad. Fibre wads are usually disc-shaped, configured to provide a gas-tight barrier between a powder charge at one end of the cartridge and a plurality of shot, or a single slug, within a cardboard or plastic cartridge sleeve which is capped at one end by a brass cap. Plastic wads generally comprise a charge barrier connected by a compression zone to a receptacle for holding shot. The compression zone is compressed in the cartridge to aid in compacting the powder charge. The compression zone may also compensate for different hull lengths and shot loads, or may be reduced or removed for steel and heavy loads because of larger shot volumes required.

The brass cap has a primer therethrough for igniting the charge. The cartridge is sealed at the other end by using a known "roll-turn-over" (RTO) method of crimping the end of the sleeve over the opening. A cardboard or fibre disc is inserted in the sleeve on top of the shot or slug prior to the RTO of the sleeve, for the turned in sleeve edge to bear against. Another known method of sealing the other end of the of the cartridge is "crimping", which is achieved by inserting the disc in the sleeve on top of the shot, or wad, and crimping inwardly the end of the sleeve to retain the disc.

In use, the cartridge is placed into the breech of a shotgun barrel and the primer struck to ignite the charge. A rapid expansion of gas from the ignited charge then forces the shot carrying wad from the barrel's muzzle. When the wad leaves the muzzle, it is abruptly slowed down due to friction with surrounding air, and the shot travels forward from the wad toward its target.

Shot has traditionally been made from lead, which is relatively soft compared to a shotgun barrel and therefore does not damage the barrel when fired. Due to increasing awareness of the detrimental effects of spent lead shot on flora and fauna, there has been a concerted effort in recent years to replace lead shot with shot made from other materials. Some authorities have also banned the use of lead shot in certain areas. Examples of lead shot replacement materials include steel, bismuth, tungsten-iron, tungsten-nickel-iron and tungsten-polymer. Steel is a preferred replacement to lead for reasons such as low environmental impact and relatively low cost. However when used with fibre wads, steel shot tends to damage shotgun barrels. Steel shot therefore necessitates the use of plastic wads, since the shot receptacle protects the barrel from contact with the shot during its passage through the barrel. The design of the plastic wad has the added advantage of improving the shot grouping or firing pattern due to radially constraining the shot prior to leaving the barrel.

However, as wads are typically left where they fall when fired from a gun, there is increasing concern as to potential detrimental environmental and aesthetic effects of plastic wads littering the areas in which shotguns are used.

It is an object of at least a preferred embodiment of the present invention to overcome or ameliorate at least one of the deficiencies of the prior art, or at least to provide a suitable alternative thereto.

SUMMARY OF THE INVENTION

According to a first aspect of the invention there is provided a wad for a projectile cartridge, the wad comprising:

- a holder for holding a projectile;
- a charge barrier; and
- a support for mounting the holder to the barrier,
- wherein the wad is unitary and is formed from a biodegradable plastic material.

According to another aspect of the invention there is provided a projectile cartridge comprising:

- a sleeve having a base at one end and an opening at another end;
- a unitary wad within the sleeve comprising a holder for holding a projectile, a charge barrier, and a support for mounting the holder to the barrier,
- a charge material in the sleeve between the base and charge barrier;
- a primer in the base for igniting the charge material;
- a projectile in holder; and
- a capping element for closing the opening end of the sleeve,
- wherein the wad is formed from a biodegradable plastic material.

Preferred features of the wad and projectile cartridge aspects are defined in their corresponding dependent claims.

The wad preferably comprises polyvinyl alcohol (PVA) typically having a flexural modulus similar to other extrudable polymers. Known advantageous properties of PVA, such as its high tensile strength, good puncture resistance, and good barrier characteristics are retained in an extrudable composition which can be processed on current extrusion lines, blow-moulders and injection moulders without modification, and without the processing problems such as thermal degradation and high temperature cross linking, observed in attempts to extrude articles using hitherto known PVA-containing compositions.

The PVA of the embodiments disclosed herein has a molecular weight which varies from around 20,000, in some cases from around 10,000, to greater than 150,000. Generally, the application of the disclosed technique is not limited to PVA of any particular percent hydrolysis nor of any particular molecular weight.

The filled PVA-containing composition disclosed herein comprises a blend of PVA plus filler. In this composition, the filler is effectively a bulking agent and is relatively inexpensive compared to the PVA, thus a composition is obtained retaining advantageous properties of PVA whilst being cheaper per unit weight to produce.

Preferably the PVA-containing compositions are provided in the form of pellets or tablets. These preferably have a size of between about 1 mm and 5 mm in diameter and are suitably obtained by a method in which PVA, preferably substantially uncompounded and in powder or granular form, is mixed with lubricant and filler and other compounding ingredients, and cold pressed to form a tablet or pellet. This cold-pressing method is substantially as described in WO-A-98/26911 in relation to different polymers.

The ingredients can be uniformly mixed and compounded in the correct proportions for the final product, and made into a form that is easier to handle than powder. In addition, the mixture is preferably cold pressed rather than melted, therefore problems of thermal degradation or variation in properties are reduced.

References to "cold pressing" are intended to imply applying pressure to the powder to cause agglomeration without substantial melting of the polymer. The temperature is preferably less than about 100 degrees Celsius, more preferably less than about 70-80 degrees Celsius. Preferably heat is not applied directly to the mixture. However, heat may be generated by mixing and/or pressing, and this may be allowed to warm the mixture, or cooling may be provided. It is permissible for some heat to be applied directly if necessary to facilitate Fillers for incorporation into compositions disclosed herein may suitably be selected from conventional polymer fillers. Typically the filler is an inert, inorganic material and a particularly preferred filler is or comprises talc, calcium carbonate. In a specific embodiment disclosed herein, this talc may be micronised, such as in particles with a mean size of about 20 microns and may further be coated, such as with a stearate. One such coated, micronised talc is available from Croxton and Gary as 90T (trade mark of Croxton and Gary).

It is further an option for the filler to comprise or consist of a superabsorbent material. In a specific example described below, a filled PVA-containing composition comprises a superabsorbent which contains cross-linked sodium polyacrylate (available from Alloid Colloids as SALISORB CL3 1(registered trade mark)).Filled compositions disclosed herein may nevertheless contain superabsorbent material of substantially any type. Incorporation of such superabsorbent material confers the particular advantage that sanitary products such as diapers and sanitary towels, hitherto major components of waste storage sites such as land-fill sites, may now be made of or comprise a significant proportion of bio-degradable material.

A number of water-absorbent compositions are known and suitable for use as the filler. For example, U.S. Pat. Nos. 3,954,721 and 3,983,095 disclose preparations for derivatives of copolymers of maleic anhydride with at least one vinyl monomer in fibrous form. The fibrous copolymers are rendered hydrophilic and water-swellable by reaction with ammonia or an alkali metal hydroxide. U.S. Pat. No. 3,810,468 discloses lightly cross-linked olefin-maleic anhydride copolymers prepared as substantially linear copolymers and then reacted with a diol or a diamine to introduce cross-linking. The resultant lightly cross-linked copolymers are treated with ammonia or an aqueous or alcohol solution of an alkali metal hydroxide. U.S. Pat. No. 3,980,663 describes water-swellable absorbent articles made from carboxylic polyelectrolytes via cross-linking with glycerine diglycidyl ether. These patents are incorporated herein by reference.

The plasticiser is present to lower the melt temperature of the polymer. The plasticiser may suitably be selected from glycerine, ethylene glycol, triethylene glycol, low molecular weight polyethylene glycols, low molecular weight amides and propylene glycols. A particularly preferred plasticiser comprises or consists of glycerol. Alternatively, the plasticiser may comprise a combination of two or more of the plasticisers listed above. For example, the plasticiser may consist of a combination or mix of glycerine and propylene glycol.

The plastic used in providing the wad and/or sleeve according to any of the aspects of the present invention may be any one of the PVA-containing compositions described in our patents GB-A-2340835 and GB-A-2378705, and in our co-pending GB patent application filed 13 Jan. 2005 entitled "PVA-containing compositions", the contents of which are incorporated herein by reference.

The resultant wad is preferably cold water soluble, though alternatively may be hot water soluble. Also, in alternative embodiments, the pigment may act as the filler.

According to another aspect of the invention there is provided a method of manufacturing a wad for a projectile cartridge comprising the step of forming the wad from a biodegradable polymer using an injection moulding process.

Preferably, the wad formed from the injection moulding step has a first moisture content and the method further comprises a step of conditioning the injection moulded wad to have a second moisture content. Preferably, the conditioning step comprises subjecting the injection moulded wad to a humid environment.

Preferably, for all aspects of the present invention, the first moisture content is <0.5% by weight and more preferably substantially 0% by weight. Also preferably, the second moisture content is 0.5 to 20% by weight, or 1 to 20% by weight, or 2 to 15% by weight, or 3 to 10% by weight, or about 6% by weight.

Preferably, the wad is increased up to about 6% in a lateral dimension thereof, or up to about 18% by weight, when the wad is conditioned to have the second moisture content. Further preferably, the wad is increased by about 2% in the lateral dimension, or by about 6% by weight, when the wad is conditioned to have the second moisture content.

These and other preferable features are defined in the corresponding dependent method claims.

According to another aspect of the invention there is provided a set of tools for manufacturing a shotgun cartridge wad and a shotgun cartridge sleeve, comprising:

a sleeve tool adapted to form said shotgun cartridge sleeve, said sleeve having a cylindrical hollow portion; and a wad tool adapted to form said shotgun cartridge wad, said wad having a cylindrical portion, wherein the wad tool is configured such that an outer diameter of said cylindrical portion of said wad is up to 6% smaller than an inner diameter of said cylindrical hollow portion of said sleeve.

Preferred features of the set of tools are defined in the corresponding dependent claims.

As will be understood, use of the term "polymer" in the description and claims, is taken to mean a single polymer, or mixes which include one or more polymers and non-polymers. Also, in the description and claims, where % weight amounts are provided for components of the plastic, these % weight amounts do not take into account whether or not moisture or water is present in the plastic. Therefore, where water or moisture is present in the plastic, the % weight amounts of the components of the plastic are to be adjusted accordingly.

BRIEF DESCRIPTION OF THE DRAWINGS

Preferred embodiments of the invention will now be described, by way of example only, with reference to the accompanying drawings where like reference numerals denote like parts, in which.

DETAILED DESCRIPTION OF THE EMBODIMENTS

Figure 1:
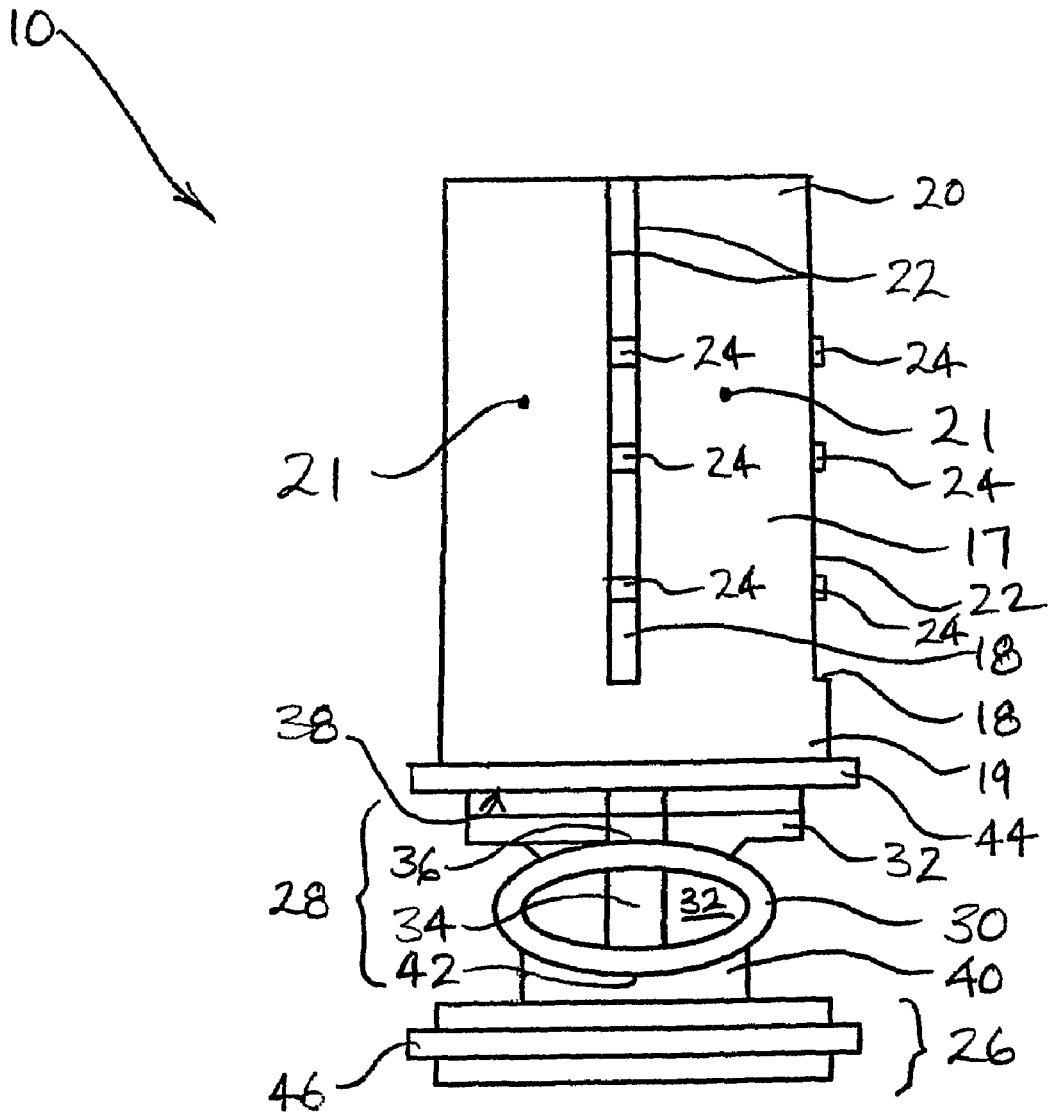
FIG. 1 illustrates a side elevation of an embodiment of a wad for a shotgun cartridge in accordance with the present invention.
Figure 2:
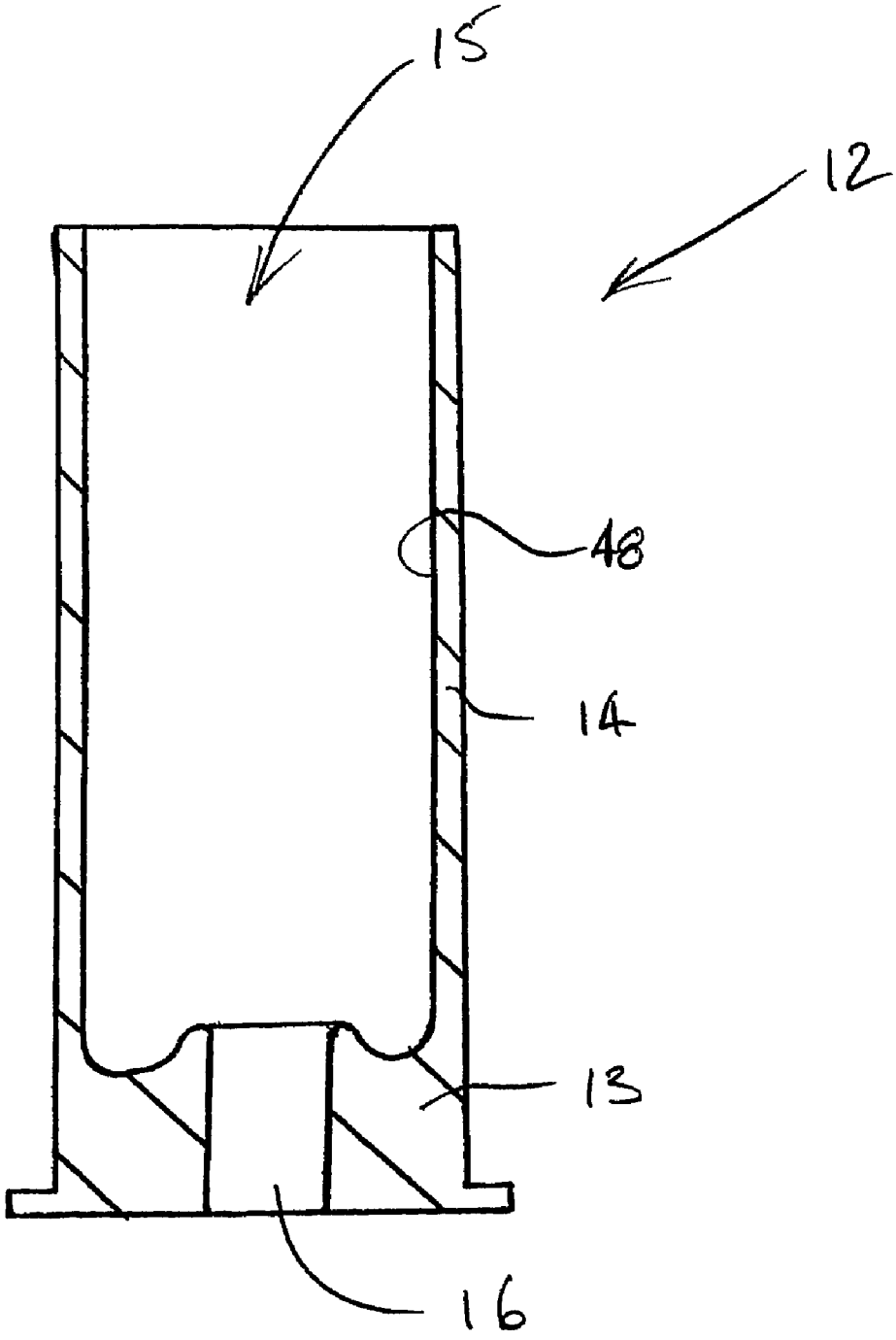
FIG. 2 illustrates a cross-sectioned side elevation of an embodiment of a shotgun cartridge case for use with the present invention.
Figure 4:
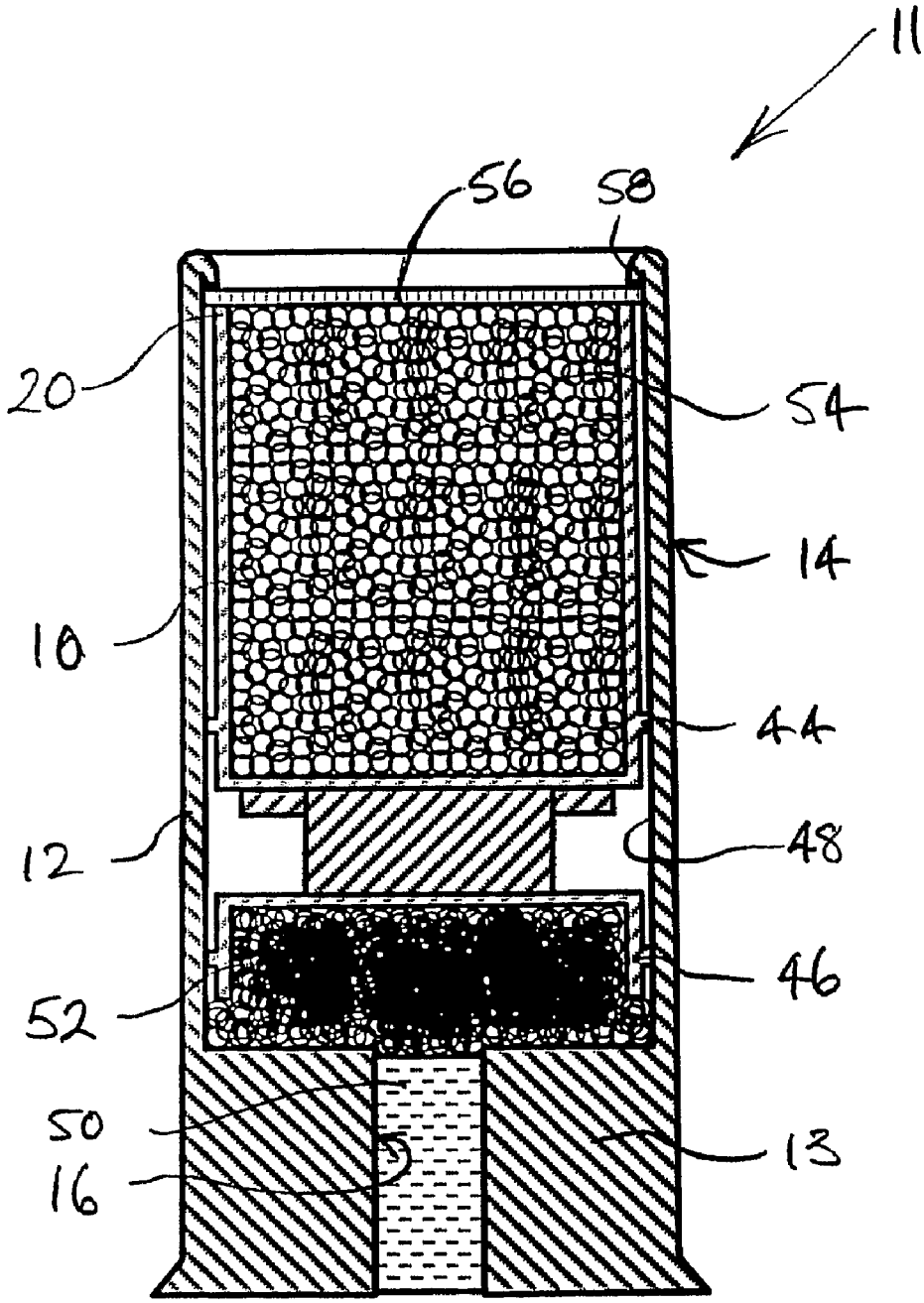
FIG. 4 illustrates cross-sectioned side elevation of an embodiment of a shotgun cartridge in accordance with the present invention.

Referring to FIGS. 1 and 4, a preferred embodiment of the present invention comprises a plastic wad 10 for a shotgun cartridge 11. The wad 10 is configured for insertion into a shotgun cartridge sleeve 12, illustrated in FIG. 2. The sleeve has a base 13 and a cylindrical sidewall 14 extending upwardly from the base 13, the sidewall 14 defining an opening 15 at an end of the sleeve 12 distal to the base 13. A primer hole 16 is located in the base 13 for fixedly receiving a primer.

The wad 10 comprises a holder in the form of a generally cylindrical cup 17 for holding and radially constraining a projectile in the form of a plurality of shot. The cup comprises four longitudinal slots 18 equispaced about a longitudinal axis of the wad 10 and extending from adjacent a proximal end 19 of the cup 17 to a distal end 20. The slots define four wall portions 21 of the cup. Opposed slot edges 22 are joined by frangible bridges 24. The slots 18 and bridges 24 are described in more detail below with respect to using the shotgun cartridge.

The wad 10 also comprises a compressible charge barrier 26 which is joined or mounted to the cup 17 by a support 28. The support 28 comprises a partly hollow cylindrical portion 30 which is oval in cross-axial cross section. The cylindrical portion 30 includes a structural element in the form of two ribs 32, 34 within the portion 30. The two ribs 32, 34 lie on perpendicular planes which are parallel to the longitudinal axis of the wad 10. The ribs 32, 34 extend through an end 36 of the cylindrical portion 30 adjacent the cup 17 to mount to the cup's base 38 to reduce the compressibility of the support 28. A cylindrical block 40, co-axial with the wad 10, extends from another end 42 of the cylindrical portion 30 adjacent the charge barrier 26, the block 40 mounting the support 28 to the barrier 26. While the block 40 is solid in this embodiment, it may be hollow in alternative configurations.

Figure 3:
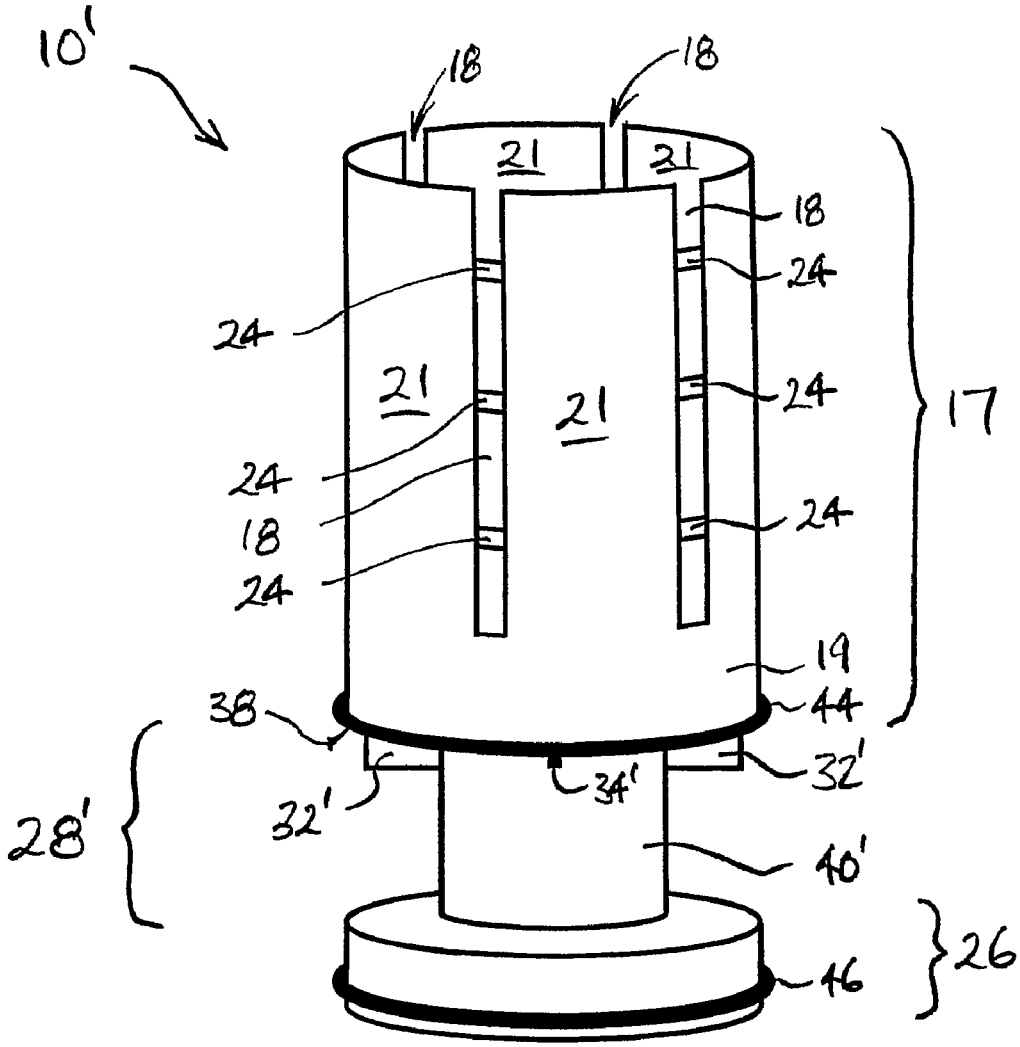
FIG. 3 illustrates an alternative embodiment of the wad.

Referring to FIG. 3, the support 28' in an alternative embodiment of the wad 10' comprises only the cylindrical block 40' and the two ribs 32', 34'. The block 40' extends between the base 38 of the cup 17 and the charge barrier 26. The ribs 32', 34', in a similar arrangement to the ribs 32, 34 of the above described embodiment, spread any force imparted through the support 28' to the cup 17 across its base 38 and to provide structural support to the base 38. In a variation of this alternative embodiment, the support 28 comprises only the cylindrical bock extending between the base 38 and the charge barrier 26. In all embodiments of the wad 10, the block 40 and the support 28 are arranged to be substantially less compressible than the charge barrier 26.

As will be appreciated, the structure of the embodiments of the wad 10 vary substantially from prior art plastic wads. Prior art plastic wads are typically formed from polyethylene. Due to the relatively low elasticity of polyethylene, the equivalent support is configured as the compression device, typically by including one or more completely hollow cylindrical portions whose longitudinal axes are perpendicular to the longitudinal axis of the wad. The cylindrical portions of the prior art wads are completely hollow in that no structural elements pass through the cylindrical portions. In that way, when a force is applied to the prior art wad in an axial direction with respect to the wad, it is the hollow cylindrical portions which compress by collapsing laterally with respect to their axes. Since the polymer used in the present embodiment is more elastic than polyethylene, the shallow cup-like shape of the charge barrier 26 is substantially more compressible than its polyethylene prior art counterpart. It is therefore not desirable for the support 28 to include further compressible zones, such as in the support 28, but to confine the compressibility to the charge barrier. For example, this provides greater directional stability through the wad as it travels through a shotgun barrel, as described in more detail below.

The wad 10 also comprises a cup collar 44 and a charge barrier collar 46. Each of the collars 44, 46 is adapted for close fitting and gas sealing engagement with an interior wall 48 of the sleeve 12.

The wad 10 is injection moulded from a mix of components preferably comprising 50 to 67% polyvinyl alcohol (PVA); 20 to 30% of filler in the form of calcium carbonate; 15 to 17% of plasticiser being a mix of glycerine and propylene glycol; up to 1% of pigment in the form of titanium dioxide; and 1 to 2% of binder, being a mix of calcium stearate, zinc stearate and stearamide.

To form the wad 10, it is injection moulded from a mix according to any one of the examples listed in Table 1. The moulding process is carried out at temperatures in excess of 100° C., which means the amount of water present in the moulded wad once released from the mould is negligible. The moulded wad is then removed from its mould and is conditioned by being placed in a humid environment of about 40° C. at 80% relative humidity for about 1 hour. The conditioning step increases the wad in size to a predetermined size desired for use. The moulded plastic is hydrophilic, readily absorbing moisture from the humid environment. The conditioning of the wad is preferred to improve (increase) the elasticity and flexibility of the wad. Improving the elasticity and flexibility reduces the chance of wad failure during firing of the cartridge 11.

Also, as has been surprisingly found by the inventors, the conditioning step has the added advantage of providing more flexibility and chemical stability to the end product than by adding more plasticiser. Merely adding more plasticiser to achieve a similar flexibility to the conditioned product will result in a chemically unstable product which will "sweat" plasticiser over time. This results in a non-homogenous product which is more brittle internally than externally. However, by keeping the amount of plasticiser in the mix below a predetermined threshold (determined whereby a minimal amount or no plasticiser will sweat from the product), and then conditioning the moulded product in accordance with the preferred embodiments of the invention improves the product's flexibility while maintaining its chemical stability.

Once the wad has reached the predetermined size from the conditioning step, it is removed from the humid environment. The mould and the conditioning step are configured such that the conditioned wad will be about 2% larger in at least one dimension thereof (about 6% larger by wad weight) than the wad when removed from the mould. The introduction of water to the wad 10 (by placing the wad in the humid environment) is desirable to increase the wad's compressibility and elasticity to a desired amount. Whereas, the wad can be conditioned up to 6% larger in said one dimension than the pre-conditioned wad, it has been found that if the wad is conditioned to be greater than 6% in said one dimension or greater than about 20% by weight of the wad, its structural integrity may be detrimentally affected such that it is not strong enough for its intended use.

For practical purposes, the wad dimension which is preferably considered for its increase in size is the diameter of the barrier 26, since it is the barrier diameter which is critical in terms of desired fit within the sleeve 12. Therefore, moulding tools for moulding the sleeve 12 and the wad 10 are configured such that the outer diameters of the barrier 26 of the preconditioned wad 10 produced by the wad moulding tool is about 2% smaller than the diameter of the interior wall 48 of the sleeve 12 produced by the sleeve mould. Of course, this is assuming, as is preferred, that the moulded, or formed wad 10 will be conditioned to increase its barrier's 26 diameter by about 2%, whereas the sleeve 12 will not be conditioned.

Example resultant wads 10 produced from the method and plastic mix described above have been successfully tested for compliance with European Standard test BS EN:13432 for "compostability and anaerobic treatability of packaging and packaging material". They have also been tested for water solubility, having been found to dissolve within hours of submersion in water. Wads produced from the above described method are also non-toxic to flora and fauna.

Another preferred embodiment of the invention is a shotgun cartridge 11, illustrated in FIG. 4, which employs the embodiments of the wad 10' described above. The cartridge is formed by fixing a primer 50 in the primer hole 16 of the sleeve 12. Powder charge 52 is loaded into the sleeve 12 and the wad 10 placed therein, such that the charge barrier 26 is adjacent the powder charge 52. The cup 17 is substantially filled with a plurality of shot pellets 54. The wad 10 is particularly useful for holding steel shot, but any other known material suitable as shot may also be used. Non-limiting examples of shot-suitable material include lead, bismuth, tungsten-iron, tungsten-nickel-iron, tungsten-polymer. Alternatively, a single slug is used in place of the plurality of shot 54. The sleeve's opening 15 is closed by fixing a sealing disc 56 therein, preferably using the above described RTO method. The sealing disc 56, pushed upon by the turned-over end 58 of the sleeve sidewall 14, applies a downward force on the distal end 20 of the cup 17. In this way, the wad 10 at its charge barrier 26 presses against the charge powder 52, applying a compressive force thereto, and also bulges at least slightly.

The sleeve 12 of the cartridge 11 is preferably injection moulded from the example plastic mix described above, though need not be the same mix as provided in forming the wad 10 used therewith. Also, the sleeve 12 may or may not be conditioned as described above with respect to the wad 10. Due to the hydrophilic nature of the plastic used in moulding the sleeve 12, the exterior of the sleeve 12 is coated in a natural or other lacquer or moisture/humidity barrier to prevent the sleeve 12 taking up moisture from the atmosphere after the cartridge has been manufactured and is stored prior to use. Shellac is an example of a preferred barrier. Shellac is able to be applied to the outer sleeve 12 such that as a coating it is integral during storage of the cartridge 11, yet is brittle enough to crack when the cartridge 11 is fired. Once cracked, moisture can then contact the plastic sleeve so that it biodegrades. Alternatively the sleeve 12 is formed from a non-biodegradable or hydrophobic plastic, or non-plastic such as cardboard for example, by methods known in the art.

The cartridge 11 is designed for breech loading in a shotgun barrel. When the primer 50 is struck by the shotgun's firing pin it explodes, igniting the powder charge 52. The burning charge produces a rapidly heating and expanding gas between the sleeve base 13 and the charge barrier 26. Due to the close fitting arrangement of the collars 44, 46 on the sleeve interior wall 48, the gas is prevented from escaping between the wad 10 and the interior wall 48, and thus forces the wad 10 from the sleeve 12 and the shotgun's muzzle. Also, due to the cup-like shape of the charge barrier 26, the force of the expanding gas causes the charge barrier 26 to bulge further and press further against the shotgun barrel, thus further preventing the expanding gas from travelling between the charge barrier 26 and the shotgun barrel. As the wad 10, still carrying the shot 54, leaves the muzzle, the cup 17 is no longer constrained by the shotgun barrel. Drag from surrounding air acts on the cup, such that the frangible bridges 24 break and the wall portions 21 splay outwardly from each other. This severely increases the drag on the wad 10 relative to the shot 54, such that it falls back from the shot and to the ground, typically about 20-30 m from the shotgun. If the wad 10 is left in the environment where it falls, it substantially biodegrades into non-toxic components and is therefore of insignificant detriment to the environment. If the wad 10 falls into a stream, or other water body, it substantially dissolves in the water within hours into a non-toxic substance. Similarly, if the user of the cartridge 11 should leave a spent sleeve 12 in the environment where the shotgun has been used, and the cartridge 11 is also moulded from a plastic according to a preferred embodiment of the present invention, it also biodegrades.

While the invention has been described in reference to its preferred embodiments, it is to be understood that the words which have been used are words of description rather than limitation and that changes may be made to the invention without departing from its scope as defined by the appended claims. For example, the holder may be adapted to receive a projectile in the form of a single slug. Also, the wad need not be conditioned prior to employment in a projectile cartridge. Alternatively, the conditioning step may include subjecting the moulded wad to atmospheric conditions for several days to reach the desired increase in size.

The text of the abstract filed herewith is repeated here as part of the specification.

A wad for a projectile cartridge comprises a holder for holding a projectile, such as a plurality of shot, a charge barrier, and a support for mounting the holder to the barrier. The wad is unitary and is formed from a biodegradable plastic material. The barrier is preferably compressible, and more preferably substantially more compressible than the support. The wad has a first moisture content and is adapted to be conditioned, prior to employment in a projectile cartridge, to have a second moisture content. After conditioning, the weight of the wad may be increased by up to 19%, or the size of the wad maybe increased in at least one dimension by up to 6%. A projectile cartridge employing the wad, and a method of making the wad and the projectile cartridge are also disclosed, together with tools for making the wad and sleeve.

The invention claimed is:

1. A wad for a projectile cartridge, the wad comprising:
a holder for holding a projectile;
a charge barrier; and
a support for mounting the holder to the barrier,
wherein the wad is unitary and is formed from a biodegradable plastic material, and
wherein the wad has a first moisture content and is conditioned, prior to employment in a projectile cartridge, to have a second moisture content greater than the first moisture content.

2. The wad of claim 1 wherein the barrier is compressible or is substantially more compressible than the support.

3. The wad of claim 1 wherein the barrier comprises a base coupled to the support and a flexible cylindrical sidewall extending from the base and defining an opening distal from the base.

4. The wad of claim 1 wherein the first moisture content is <0.5% by weight of the wad and the second moisture content is <20% by weight of the wad.

5. The wad of claim 1 wherein when the wad has the second moisture content, it is greater in size in at least one dimension by up to 6% than when it has the first moisture content.

6. The wad of claim 1 wherein when the wad has the second moisture content, it is greater in size in at least one dimension by about 2% than when it has the first moisture content.

7. The wad of claim 1 wherein the first moisture content is substantially 0% by wad weight.

8. The wad of claim 1 wherein the plastic comprises polyvinyl alcohol (PVA) and plasticiser.

9. The wad of claim 8 wherein the plasticiser comprises glycerine and/or propylene glycol.

10. The wad of claim 1 wherein the plastic comprises, by weight, 40 to 95% of PVA and 5 to 20% plasticiser.

11. The wad of claim 1 wherein the plastic comprises, by weight, 0 to 49% filler and 0 to 5% binder.

12. The wad of claim 11 wherein the filler comprises calcium carbonate and the binder comprises 0-1% calcium stearate, and/or 0-1% zinc stearate, and/or 0-2% stearamide.

13. The wad of claim 1 wherein the plastic comprises, by weight: 0-2% of pigment, preferably titanium dioxide.

14. The wad of claim 1 wherein the plastic comprises, by weight:

40 to 95% of PVA;

5 to 20% of glycerine and/or propylene glycol as plasticiser;

0 to 49% of calcium carbonate as filler;

0-1% calcium stearate, and/or 0-1% zinc stearate, and/or 0-2% stearamide as binder; and 0-2% of titanium dioxide as pigment, the total amount being 100%.

15. The wad of claim 1 wherein the plastic comprises, by weight:

0 to 67% PVA; 0 to 30% calcium carbonate;

15 to 17% glycerine and/or propylene glycol;

0 to 1% titanium dioxide; and 0 to 0.3% calcium stearate, and/or 0 to 0.2% zinc stearate, and/or 0-1.5% stearamide, the total amount being 100%.

16. The wad of claim 1 wherein the support comprises a partly hollow portion having a structural element therein for maintaining the structural integrity of the partly hollow portion.

17. The wad of claim 16 wherein structural element comprises a rib which lies on a plane substantially parallel to a longitudinal axis of the wad.

18. The wad of claim 17 wherein the partly hollow portion comprises a cylinder having a longitudinal axis across the longitudinal axis of the wad, and wherein the rib is internal of the cylinder.

19. The wad of claim 17 comprising a second rib, each rib lying on a respective plane substantially parallel to the longitudinal axis of the wad, and wherein the planes on which each of the ribs lies intersect each other.

20. The wad of claim 1 wherein the support comprises a solid post.

21. The wad of claim 1 wherein the projectile comprises a plurality of shot and the holder is configured to radially constrain the shot.

22. The wad of claim 1 wherein the projectile comprises a slug.

23. The wad of claim 1 wherein the holder comprises a cup.

24. The wad of claim 23 wherein the cup comprises a base and a cylindrical sidewall extending from the base, the sidewall comprising longitudinally directed slots extending through a distal end of the sidewall.

25. The wad of claim 1 being cold water soluble.

26. A projectile cartridge comprising:

a sleeve having a base at one end and an opening at another end;

a unitary wad within the sleeve comprising a holder for holding a projectile, a charge barrier, and a support for mounting the holder to the barrier, a charge material in the sleeve between the base and charge barrier;

a primer in the base for igniting the charge material;

a projectile in the holder; and a capping element for closing the opening end of the sleeve, wherein the wad is formed from a biodegradable plastic material, and wherein the wad has a first moisture content and is conditioned, prior to employment in a projectile cartridge, to have a second moisture content greater than the first moisture content.

27. A wad for a projectile cartridge, the wad comprising:

a holder for holding a projectile;

a charge barrier; and a support for mounting the holder to the barrier, wherein the wad is unitary and is formed from a biodegradable plastic material, and further wherein the plastic comprises, by weight;

40 to 95% of PVA;

5 to 20% of glycerine and/or propylene glycol as plasticiser;

0 to 49% of calcium carbonate as filler;

0-1% calcium stearate, and/or 0-1% zinc stearate, and/or 0-2% stearamide as binder; and 0-2% of titanium dioxide as pigment, the total amount being 100%.

28. A wad for a projectile cartridge, the wad comprising:

a holder for holding a projectile;

a charge barrier; and a support for mounting the holder to the barrier, wherein the wad is unitary and is formed from a biodegradable plastic material, and further wherein the plastic comprises, by weight:

0 to 67% PVA;

0 to 30% calcium carbonate;

15 to 17% glycerine and/or propylene glycol;

0 to 1% titanium dioxide; and 0 to 0.3% calcium stearate, and/or 0 to 0.2% zinc stearate, and/or 0-1.5% stearamide, the total amount being 100%.

* * * * *